US008687816B2

(12) United States Patent
Shi et al.

(10) Patent No.: US 8,687,816 B2
(45) Date of Patent: Apr. 1, 2014

(54) SIGNAL PROCESSING

(75) Inventors: Shengrong Shi, Beijing (CN); Changjiang Zhang, Beijing (CN)

(73) Assignee: Nokia Corporation, Espoo (FI)

( * ) Notice: Subject to any disclaimer, the term of this patent is extended or adjusted under 35 U.S.C. 154(b) by 466 days.

(21) Appl. No.: 12/494,707

(22) Filed: Jun. 30, 2009

(65) Prior Publication Data

US 2010/0329469 A1 Dec. 30, 2010

(51) Int. Cl.
*H04R 29/00* (2006.01)

(52) U.S. Cl.
USPC ..... 381/56; 381/58; 381/59

(58) Field of Classification Search
USPC ..... 381/56, 58, 59, 74, 104, 105, 109, 150, 381/95, 96
See application file for complete search history.

(56) References Cited

U.S. PATENT DOCUMENTS

| | | | | |
|---|---|---|---|---|
| 4,281,223 | A * | 7/1981 | Ugaji et al. | 381/408 |
| 4,327,257 | A * | 4/1982 | Schwartz | 381/405 |
| 4,465,477 | A * | 8/1984 | AvGavaar | 434/233 |
| 4,901,357 | A * | 2/1990 | Albright | 381/400 |
| 8,009,857 | B2 * | 8/2011 | Bohlender et al. | 381/400 |
| 2004/0034684 | A1 * | 2/2004 | Payne | 709/201 |
| 2007/0237170 | A1 * | 10/2007 | Proctor et al. | 370/462 |
| 2008/0260176 | A1 * | 10/2008 | Hollemans et al. | 381/74 |
| 2008/0278354 | A1 * | 11/2008 | Garrett | 341/32 |

FOREIGN PATENT DOCUMENTS

| | | | |
|---|---|---|---|
| WO | 2004/093490 | A1 | 10/2004 |
| WO | WO 2004093490 | A1 * | 10/2004 |
| WO | 2005/051034 | A1 | 6/2005 |
| WO | 2006075275 | | 7/2006 |
| WO | WO 2006075275 | A1 * | 7/2006 |
| WO | 2007049254 | | 5/2007 |
| WO | WO 2007049254 | A1 * | 5/2007 |
| WO | 2007120413 | | 10/2007 |
| WO | 2007141769 | | 12/2007 |
| WO | WO 2007141769 | A2 * | 12/2007 |

OTHER PUBLICATIONS

International Search Report dated Jun. 8, 2010.
Written Opinion dated Jun. 8, 2010.

* cited by examiner

*Primary Examiner* — Vivian Chin
*Assistant Examiner* — Friedrich W Fahnert
(74) *Attorney, Agent, or Firm* — Harrington & Smith

(57) ABSTRACT

An apparatus, method and a computer program are provided. The apparatus is configured to process an electrical output signal from a loudspeaker to detect a user input signal.

25 Claims, 6 Drawing Sheets

SIGNAL PROCESSING

BACKGROUND

Field

The disclosed embodiments relate to signal processing. In particular, they relate to processing an electrical output signal from a loudspeaker.

An electronic device may have a user input device, such as a keyboard or keypad. In many instances, the user input device is dedicated to user input.

BRIEF DESCRIPTION OF THE DISCLOSED EMBODIMENTS

According to various, but not necessarily all of the disclosed embodiments there is provided an apparatus, configured to process an electrical output signal from a loudspeaker to detect a user input signal.

The apparatus may be configured, in response to detecting a user input signal, to provide a further electrical output signal to circuitry different to the loudspeaker. The further electrical output signal may be for causing the circuitry to perform a function.

The apparatus may be configured to detect a user input signal by determining whether the electrical output signal has at least one characteristic. The apparatus may be configured to detect a user input signal by determining whether the electrical output signal has at least a first characteristic and a second characteristic.

The apparatus may be configured to determine whether the electrical output signal has the second characteristic a predetermined period of time after determining that the electrical output signal has the first characteristic.

The apparatus may be configured to provide a drive signal for driving the loudspeaker.

According to various, but not necessarily all of the disclosed embodiments, there is provided a method, comprising: processing an electrical output signal from a loudspeaker to detect a user input signal.

The method may further comprise: providing, in response to detecting a user input signal, a further electrical output signal to circuitry different to the loudspeaker. The further electrical output signal may cause the circuitry to perform a function.

A user input signal may be detected by determining whether the electrical output signal has at least one characteristic. A user input signal may be detected by determining whether the electrical output signal has at least a first characteristic and a second characteristic.

The apparatus may be configured to determine whether the electrical output signal has the second characteristic a predetermined period of time after determining that the electrical output signal has the first characteristic.

According to various, but not necessarily all of the disclosed embodiments, there is provided a tangible computer-readable medium storing a computer program, the computer program comprising computer program instructions that, when run by a processor, enable: processing an electrical output signal from a loudspeaker to detect a user input signal.

The computer program instructions may further enable: providing, in response to detecting a user input signal, a further electrical output signal to circuitry different to the loudspeaker. The further electrical output signal may cause the circuitry to perform a function.

A user input signal may be detected by determining whether the electrical output signal has at least one characteristic. The user input signal may be detected by determining whether the electrical output signal has at least a first characteristic and a second characteristic.

According to various, but not necessarily all of the disclosed embodiments, there is provided an apparatus, comprising: means for processing an electrical output signal from a loudspeaker to detect a user input signal.

The apparatus may further comprise: means for providing, in response to detecting a user input signal, a further electrical output signal to circuitry different to the loudspeaker.

According to various, but not necessarily all of the disclosed embodiments, there is provided an apparatus, configured to process an electrical output signal from a loudspeaker to detect an impact signal.

According to various, but not necessarily all of the disclosed embodiments, there is provided a method, comprising: processing an electrical output signal from a loudspeaker to detect an impact signal.

According to various, but not necessarily all of the disclosed embodiments, there is provided a tangible computer-readable medium storing a computer program, the computer program comprising computer program instructions that, when run by a processor, enable: processing an electrical output signal from a loudspeaker to detect an impact signal.

According to various, but not necessarily all of the disclosed embodiments, there is provided an apparatus, comprising: means for processing an electrical output signal from a loudspeaker to detect an impact signal.

BRIEF DESCRIPTION OF THE DRAWINGS

For a better understanding of various examples of the disclosed embodiments reference will now be made by way of example only to the accompanying drawings in which.

DETAILED DESCRIPTION OF THE DISCLOSED EMBODIMENTS

Figure 1:
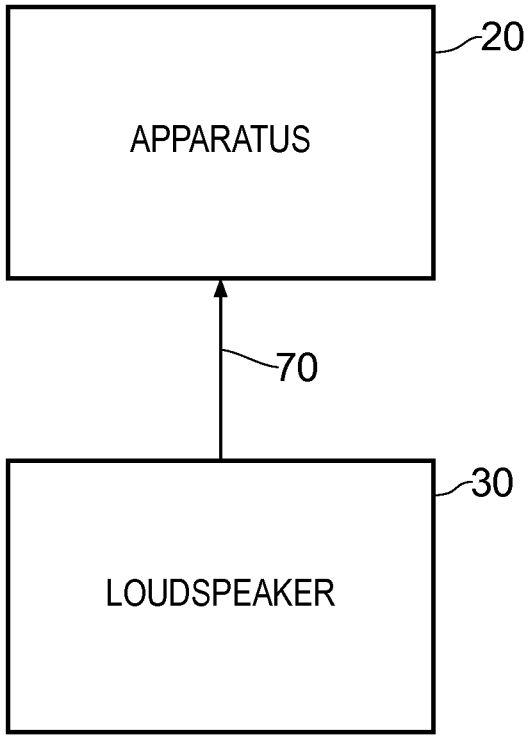
FIG. 1 illustrates a first apparatus and a loudspeaker.

FIG. 1 illustrates an apparatus 20 and a loudspeaker 30. The apparatus 20 may, for example, be processing circuitry. The apparatus 20 is configured to process an electrical output signal 70 from a loudspeaker 30 to detect a user input signal.

The apparatus 20 and the loudspeaker 30 are operationally coupled and any number or combination of intervening elements can exist between them (including no intervening elements).

Figure 2:
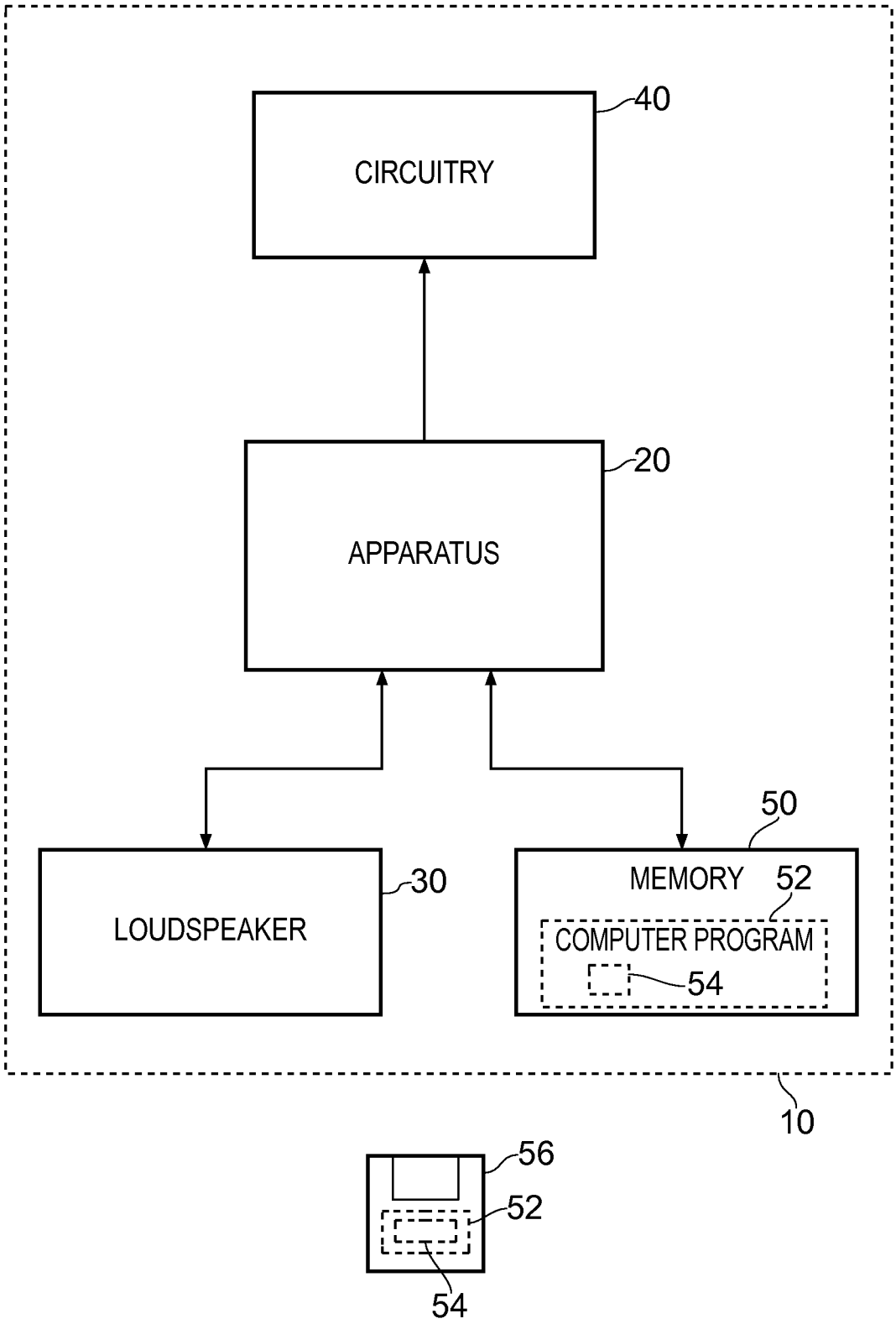
FIG. 2 illustrates a second apparatus.

FIG. 2 illustrates an apparatus 10. The apparatus 10 may, for example, be an electronic device. In some of the of the disclosed embodiments, the electronic device may be a hand portable electronic device such as a mobile telephone, personal music player, personal gaming device or a personal digital assistant.

The electronic device 10 comprises the apparatus 20 illustrated in FIG. 1. The electronic device 10 also comprises a loudspeaker 30, a memory 50, and circuitry 40.

The apparatus 20 is configured to provide electrical outputs to the loudspeaker 30 and the circuitry 40. The apparatus 20 is configured to receive an electrical input from the loudspeaker 30. The apparatus is configured to read from and to write to the memory 50.

The loudspeaker 30 may comprise a plurality of magnets and a membrane. At least one of the magnets is an electromagnet. At least one of the magnets (such as the electromagnet) is coupled to the membrane.

When an electrical signal is provided to the electromagnet by the apparatus 20, attraction and repulsion between the electromagnetic and at least one other magnet causes the membrane to move, which results in sound being produced by the loudspeaker 30.

Implementation of the apparatus 20 can be in hardware alone (a circuit, a processor . . . ), have certain aspects in software including firmware alone or can be a combination of hardware and software (including firmware).

The apparatus 20 may be implemented using instructions that enable hardware functionality, for example, by using executable computer program instructions in a general-purpose or special-purpose processor that may be stored on a computer readable storage medium (disk, memory etc) to be executed by such a processor.

The memory 50 is illustrated as storing a computer program 52 comprising computer program instructions 54 that control the aspects of the operation of the electronic device 10 when loaded into the apparatus 20. The computer program instructions 52 provide the logic and routines that enables the apparatus 20 to perform the method illustrated in FIG. 5. The apparatus 20 by reading the memory 50 is able to load and execute the computer program 52.

The computer program 52 may arrive at the electronic device 10 via any suitable delivery mechanism 56. The delivery mechanism 56 may be, for example, a computer-readable storage medium, a computer program product, a memory device, a record medium such as a CD-ROM or DVD, an article of manufacture that tangibly embodies the computer program 52. The delivery mechanism may be a signal configured to reliably transfer the computer program 52. The electronic device 10 may propagate or transmit the computer program 52 as a computer data signal.

Although the memory 50 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor', 'processing circuitry' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

Figure 3:
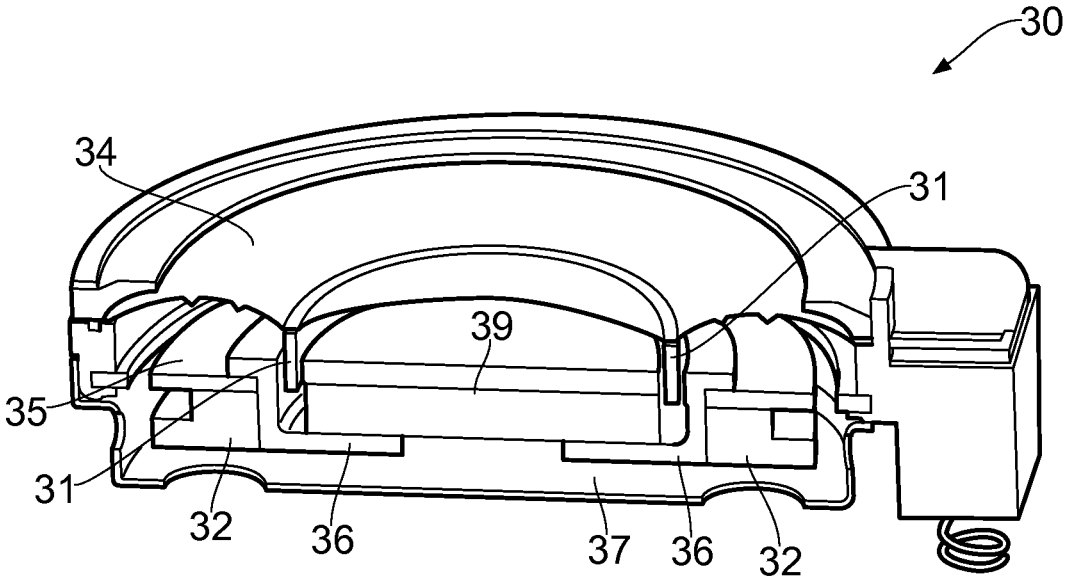
FIG. 3 illustrates a cross section of a loudspeaker.

FIG. 3 illustrates an example of a loudspeaker 30. In this example, the loudspeaker 30 is a multi-function device. It may operate as an earpiece loudspeaker (for instance, for a mobile telephone) and a hands-free loudspeaker. It may also provide a vibration function for an electronic device (such as a mobile telephone) that it is incorporated into.

The loudspeaker 30 illustrated in FIG. 3 comprises a voice coil 31, a mass 32, a membrane 34, a resilient member 35, a coupling member 36 and a permanent magnet 39. In this example, the resilient member 35 is a spring.

The mass 32 is coupled to the resilient member 35. The permanent magnet 39 is coupled to the mass 32 and the resilient member 35 via the coupling member 36. The voice coil 31 is attached to the membrane 34.

In this example, the apparatus 20 is electrically coupled to the voice coil 31. When the apparatus 20 provides an electrical drive signal to the voice coil 31, the voice coil 31 acts as an electromagnet. Attraction and repulsion between the permanent magnet 39 and the voice coil 31 cause the permanent magnet 39, the mass 32, the resilient member 35 and the connecting member 35 to move in the space 37 beneath the permanent magnet 39 and the mass 32. The attraction and repulsion between the permanent magnet 39 and the voice coil 31 also causes the voice coil 31 to move. As the voice coil 31 is attached to the membrane 34, the membrane 34 also moves, causing the loudspeaker 30 to emit sound.

Figure 4:
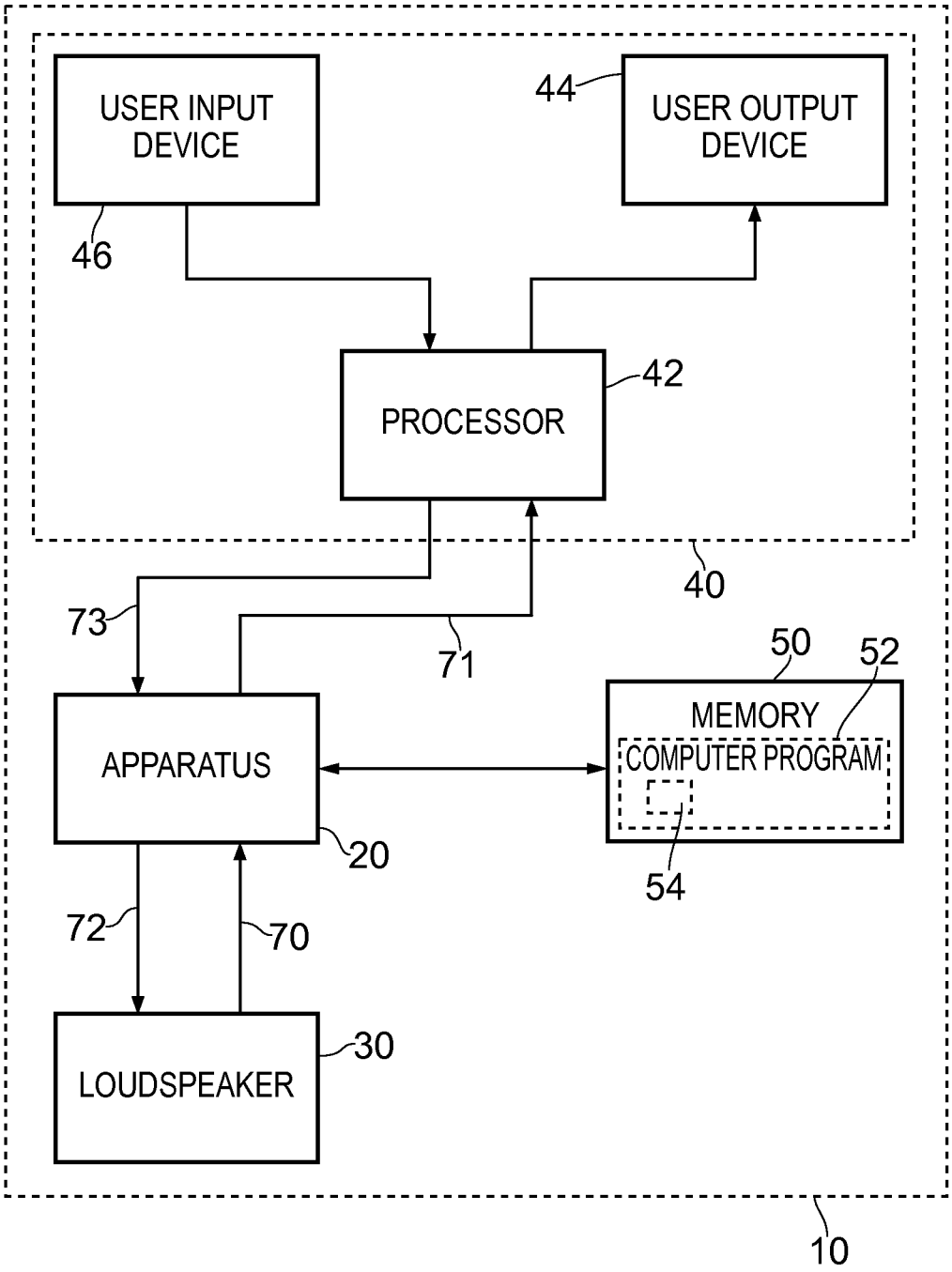
FIG. 4 illustrates a third apparatus.

FIG. 4 illustrates a more detailed example of the electronic device 10 illustrated in FIG. 2. In this example, the circuitry 40 is provided by a processor 42, a user input device 46 and a user output device 44. The user input device 46 may, for example, be a keypad. The user output device 44 may, for example, be a display.

In the example illustrated in FIG. 4, the processor 42 is configured to receive inputs from the user input device 46 and configured to provide outputs to the user output device 44. The processor 42 is configured to provide a control signal 73 to the apparatus 20 and configured to receive a control signal 71 from the apparatus 20.

The processor 42 may or may not be a central processor of the electronic device 10 (or comprise a central processor of the electronic device 10). The processor 42 may perform functions. For example, the processor 42 may be configured to control the user output device 44 to display information.

The apparatus 20 is configured to receive a control signal 73 from the processor 42. In response to receiving the control signal 73, the apparatus 20 may provide a drive signal 72 to the loudspeaker 30. The drive signal 72 may be for driving the loudspeaker 30 to produce sound.

The loudspeaker 30 is configured to provide an electrical output signal 70 to the apparatus 20, in response to a force being applied to the loudspeaker 30. When a force is applied to the loudspeaker 30, the permanent magnet 39 and the magnetic field associated with it move. This generates an electric current in the voice coil 31, which is provided as an electrical output signal to the apparatus 20. The presence of an electrical output signal 70 from the loudspeaker 30 indicates that the permanent magnet 39 is moving relative to the voice coil 31 and the properties of that electrical signal 70 (for example, the maximum amplitude of the signal 70 and the frequency of the signal 70) indicate the nature of the movement.

In some of the disclosed embodiments, a user may provide input information into the electronic device 10 by applying a force to the loudspeaker 30. The force may be applied directly to the loudspeaker 30, or indirectly via the application of a force to some other part of the electronic device 10 that is coupled to the loudspeaker 30.

In order to prevent the application of any force to the electronic device 10 being interpreted as user input, the apparatus 20 may process the electrical output signal 70 to detect whether a user input signal is present. For example, the apparatus 20 may detect a user input signal by determining that the electrical output signal 70 provided by the loudspeaker 30 has at least one characteristic associated with user input.

In response to determining that an electrical output signal 70 provided by the loudspeaker 30 has the at least one characteristic, the apparatus 20 may provide a control signal to circuitry 40 that is different to the loudspeaker 30. The control signal 71 may be for causing the circuitry 40 to perform a function.

In this particular example, the apparatus 20 is configured to provide a control signal 71 to the processor 42, in response to determining that an electrical output signal 70 provided by the loudspeaker 30 has the at least one characteristic. The control signal 71 is for causing the processor 42 to perform a function. For example, in response to receiving the control signal 71, the processor 42 may control the user output device 44 to display information.

A method according to the disclosed embodiments will now be described in relation to FIGS. 5 and 6.

Figure 5:
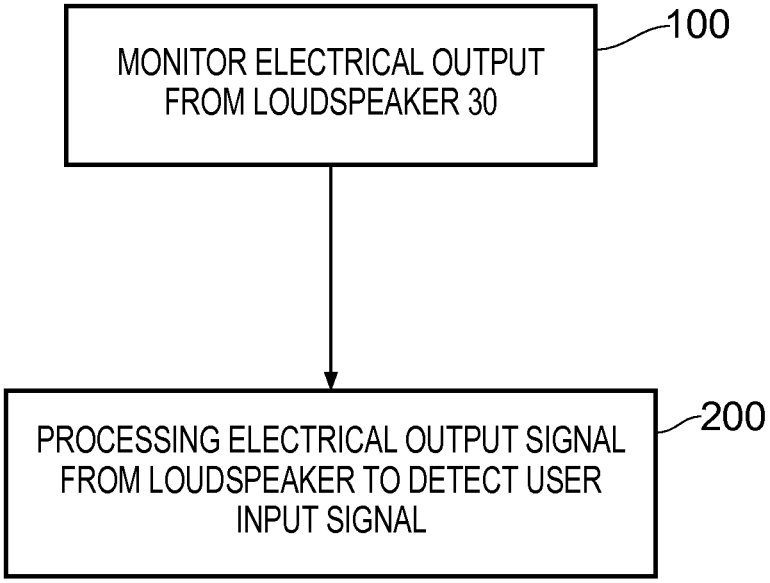
FIG. 5 illustrates a method.

At block 100 of FIG. 5, the apparatus 20 monitors the electrical output signal 70 from the loudspeaker 30 to determine whether a user input signal is present.

A user applies a first force to a surface of the electronic device 10 by striking the device 10 with a digit. The application of the first force causes the permanent magnet 39 of the loudspeaker 30 to move, and the magnetic field provided by the permanent magnet 39. An electric current in the voice coil 31 is generated due to the movement of the magnetic field. The generated electric current is provided as an electrical output signal 70 to the apparatus 20.

Figure 6:
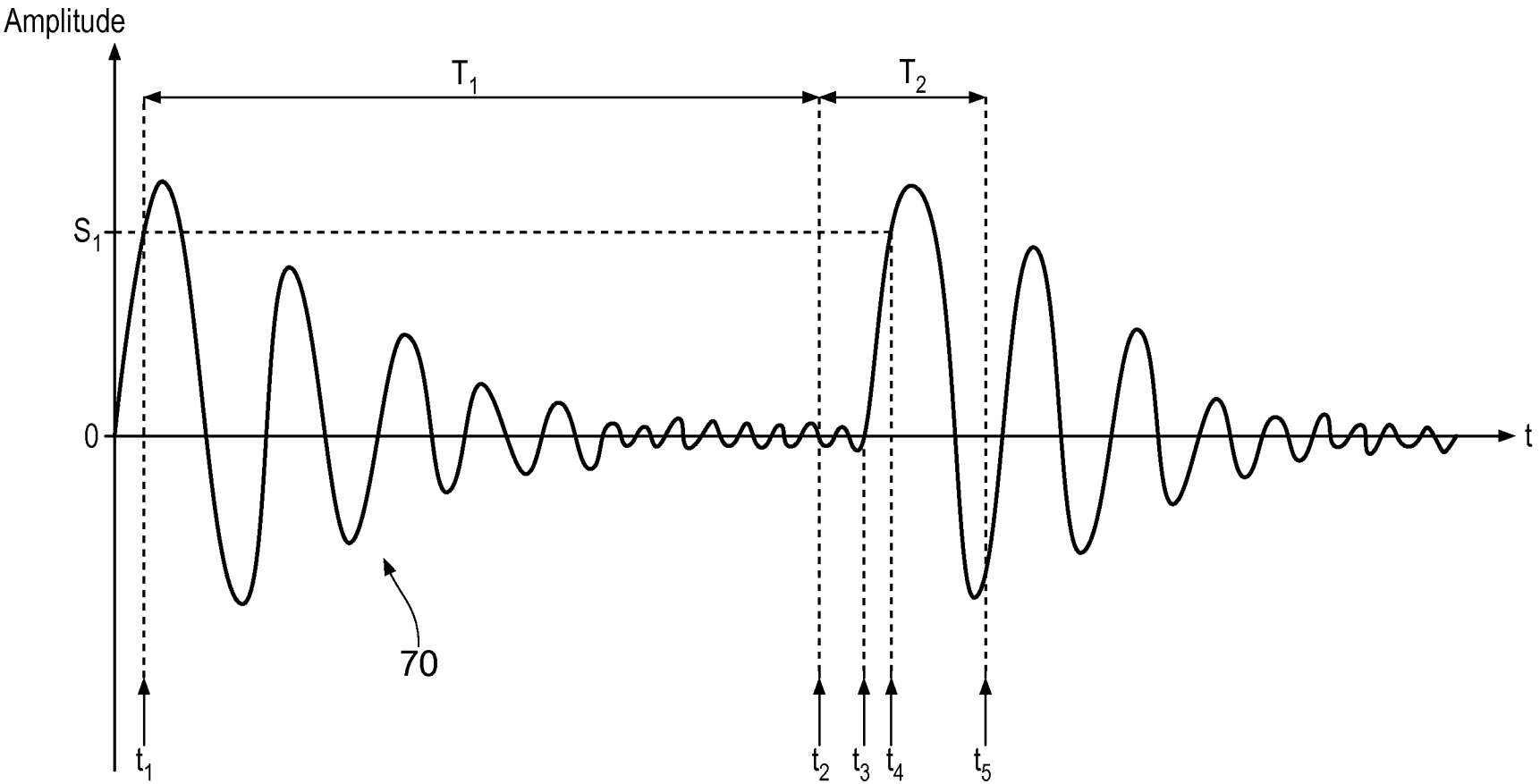
FIG. 6 illustrates an electrical output signal from a loudspeaker.

FIG. 6 illustrates an amplitude-time graph which shows the electrical signal 70 that is output by the loudspeaker 30. The user applies the first force to the electronic device 10 at the origin of the graph. The amplitude of the signal 70 rises due to the relative movement between the voice coil 31 and the magnetic field provided by the permanent magnet 39.

In this example, the permanent magnet 39 oscillates in the space 37 beneath it, along with the mass 32 and the coupling member 36. This results in an alternating current signal 70 being produced by the loudspeaker 30.

The mass 32 dampens the movement of the resilient member 35 and the permanent magnetic 39. Consequently, the maximum amplitude of the electrical signal 70 that is output by the loudspeaker 30 during an oscillation cycle reduces over time.

At block 200 of FIG. 5, the apparatus 20 processes the electrical output signal 70 provided by the loudspeaker 70 to detect a user input signal.

The apparatus 20 may be configured to determine whether the electrical output signal 70 provided by the loudspeaker 30 has a first characteristic. In this example, the apparatus 20 determines whether the electrical output signal 70 has a first characteristic by determining whether it reaches a threshold $S_1$. FIG. 6 illustrates the electrical signal 70 reaching the threshold $S_1$ at a time $t_1$.

In response to determining that the electrical output signal 70 has reached a threshold $S_1$, the apparatus 20 starts a timer. The timer counts for a first predetermined period of time $T_1$. The first predetermined period of time $T_1$ may, for example, be of the order of hundreds of milliseconds. It may be that the apparatus 20 ceases to monitor the electrical output signal 70 when the timer begins, and does not monitor the electrical signal 70 until the first predetermined period $T_1$ has elapsed.

The first predetermined period of time $T_1$ elapses at a time $t_2$. After the first predetermined period of time $T_1$ has elapsed, the apparatus 20 re-commences monitoring the electrical output signal 70.

In this exemplary embodiment, the apparatus 20 starts a timer in response to the first predetermined period of time $T_1$ elapsing. The timer counts for a second predetermined period of time $T_2$. The apparatus 20 monitors the electrical output signal 70, during the second predetermined period of time $T_2$, to determine whether the electrical signal 70 has a second characteristic.

In this instance, the second characteristic is the same as the first characteristic. It relates to the electrical output signal 70 having an amplitude above the threshold $S_1$. However, in other embodiments, the second characteristic may be different to the first characteristic.

At a time $t_3$, a user applies a second force to a surface of the electronic device 10 by striking the device 10 with a digit. The permanent magnet 39 may (or may not) still be oscillating from the application of the first force when the second force is applied.

In this particular example, the permanent magnet 39 is still oscillating when the second force is applied. The application of the second force causes the amplitude of those oscillations to increase, which in turn causes the amplitude of the alternating current signal 70 being output by the loudspeaker 30 to increase.

At a time $t_4$, the amplitude of the electrical signal 70 reaches the threshold $S_1$. When the amplitude of the electrical signal 70 reaches the threshold $S_1$, the apparatus 20 determines that the electrical signal 70 has the second characteristic.

In response to determining that the electrical signal 70 has the second characteristic, the apparatus 20 provides a control signal 71 to the circuitry 40. In this example, the apparatus 71 provides the control signal 20 to the processor 42.

The control signal 71 may be for causing circuitry 40 to perform a function. The function may be unrelated to using the loudspeaker 30 to output sound. In this example, the control signal 71 may cause the processor 42 to perform a function. For instance, in response to receiving the control signal 71, the processor 42 may control the user output device to display information, such as the current time of day.

In the exemplary embodiments described above, after the first predetermined time period $T_1$ has elapsed, the apparatus 20 monitors the electrical signal 70, for a second period of time $T_2$, to determine whether it has the second characteristic. In this example, if the apparatus 20 does not determine that the electrical signal 70 has the second characteristic within the second period of time $T_2$, it concludes that no user input signal is present. At a time $t_5$, the apparatus 20 ceases to monitor the electrical signal 70.

By not determining whether the electrical output signal 70 provided by the loudspeaker 30 has the second characteristic (of reaching the threshold signal level $S_1$) until after a first predetermined period of time $T_1$ has elapsed, the apparatus 20 may distinguish between a "double tap" made by a user and a "single tap" made by a user, or between a "double tap" made by a user and the electronic device 10 being dropped on the floor. This is because the apparatus 20 and/or the loudspeaker 30 may be configured in such a way that, following a "typical single tap" or a "typical drop", the electrical output signal 70 does not reach the threshold level $S_1$ after the first predetermined period of time $T_1$ has elapsed.

In summary, the disclosed embodiments advantageously provide a method of using acceleration of an electronic device as a form of user input, without the need to include accelerometers in the electronic device that are dedicated to user input.

In some embodiments, the apparatus 20 may be configured to determine whether the electrical output signal 70 provided by the loudspeaker 30 reaches a shock/impact threshold $S_T$. The impact threshold $S_T$ may be higher than the threshold $S_1$. The electrical output signal 70 may, for instance, reach the impact threshold $S_T$ if the electronic device 10 undergoes an impact with another object (for example, if the electronic device 10 is dropped onto the floor).

An impact signal is considered to have been detected if the electrical output signal 70 reaches the impact threshold $S_T$. The apparatus 20 may be configured, in response to determining that the electrical output signal 70 has reached the impact threshold $S_T$, to output a signal to cause circuitry to perform a function. For example, the output signal may indicate that an impact has occurred, and may be for preventing one or more electronic components from being used (for example, in order to prevent the electronic components from being damaged and/or to prevent data from being lost). The one or more electrical components may, for example, be a hard drive and/or a gyroscope.

The blocks illustrated in FIG. 5 may represent steps in a method and/or sections of code in the computer program 52. The illustration of a particular order to the blocks does not necessarily imply that there is a required or preferred order for the blocks and the order and arrangement of the block may be varied. Furthermore, it may be possible for some steps to be omitted.

Although disclosed embodiments have been described in the preceding paragraphs with reference to various examples, it should be appreciated that modifications to the examples given can be made without departing from the scope of the disclosed embodiments as claimed. For example, in the embodiments described above, the apparatus 20 is described as processing an analog electrical signal 70 that is output by a loudspeaker 30. However, it may be that the analog electrical signal 70 is converted to a digital electrical signal prior to it being processed by the apparatus 20. The analog to digital conversion may or may not be performed by the apparatus 20.

In the embodiments described above, the apparatus detects a user input signal that corresponds with a "double tap" made by a user. However, those skilled in the art will appreciate that the other types of user input may be detected. For example, in other embodiments, the apparatus 20 may be configured to detect a user input signal that corresponds with the electronic device 10 being shaken. In these embodiments, the electronic device 10 may function as a step/pace counter, where each "shake" of the electronic device 10 corresponds with a step/pace taken by a user.

Those skilled in the art will understand that a number of different configurations of loudspeaker may be used in the disclosed embodiments. It may, for example, be appropriate to take into consideration the type of user input signal that it is desirable to detect when selecting the configuration of loudspeaker to use.

In the FIG. 4 example described above, the circuitry 40 illustrated in FIG. 4 is provided by a processor 42, a user input device 46 and a user output device 44. In other embodiments, a different combination of elements may provide the circuitry 40. For example, the circuitry 40 may be provided solely by a display and the apparatus 20 may provide the control signal 71 directly to the display. In another example, at least some of the circuitry 40 may be provided by a torch, and the torch may be enabled in response to user input being detected.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the disclosed embodiments believed to be of particular importance it should be understood that the Applicant claims protection in respect of any patentable feature or combination of features hereinbefore referred to and/or shown in the drawings whether or not particular emphasis has been placed thereon.

What is claimed is:

1. An apparatus, comprising:

at least one processor; and at least one memory including computer program code, wherein the at least one memory and the computer program code are configured, with the at least one processor, to cause the apparatus to at least:

process an electrical output signal provided to the apparatus from a loudspeaker to detect a user input signal of the electrical output signal caused by at least one force applied by the user to the apparatus and transferred to the loudspeaker, wherein the electrical output signal is generated by a movement of a permanent magnet relative to a voice coil of the loudspeaker in response to the applied at least one force by the user.

2. The apparatus as claimed in claim 1, wherein the at least one memory including the computer program code is configured, with the at least one processor, to cause the apparatus, in response to detecting the user input signal, to generate a further electrical output signal to circuitry different to the loudspeaker, wherein the further electrical output signal causes the circuitry to perform a function.

3. The apparatus as claimed in claim 1, wherein the at least one force is applied by the user indirectly to the loud speaker via another part of the apparatus associated with the loudspeaker.

4. The apparatus as claimed in claim 1, wherein the at least one memory including the computer code is configured, with the at least one processor to cause the apparatus to detect the user input signal by determining whether the electrical output signal exceeds an amplitude threshold.

5. The apparatus as claimed in claim 1, wherein the at least one memory including the computer program code is configured, with the at least one processor, to cause the apparatus to detect the user input signal by determining that the electrical output signal has at least a first characteristic and a second characteristic.

6. The apparatus as claimed in claim 5, wherein the first characteristic comprises the electrical output signal exceeding an amplitude threshold, and wherein the at least one memory including the computer program code is configured with the at least one processor to cause the apparatus, in response to the electrical output signal exceeding the amplitude threshold, to start a first timer of a first predetermined period of time during which the electrical output signal is not monitored.

7. The apparatus as claimed in claim 6, wherein the computer program code is configured with the at least one processor to cause the apparatus, at an expiration of the first timer, to start a second timer of a second predetermined period of time during which the electrical output signal is monitored, wherein the second characteristic comprises the electrical output signal exceeding the amplitude threshold during the second predetermined period of time.

8. A method, comprising:

processing, with an electronic device, an electrical output signal provided to the electronic device from a loudspeaker to detect a user input signal of the electrical output signal caused by at least one force applied by a user to the electronic device and transferred to the loudspeaker, wherein the electrical output signal is generated by a movement of a permanent magnet relative to a voice coil of the loudspeaker in response to the applied at least one force by the user.

9. The method as claimed in claim 8, further comprising: generating, in response to detecting the user input signal, a further electrical output signal to circuitry different to the loudspeaker and wherein the further electrical output signal causes the circuitry to perform a function.

10. The method as claimed in claim 9, wherein the at least one force is applied by the user indirectly to the loud speaker via another part of the electronic device associated with the loudspeaker.

11. The method as claimed in claim 8, wherein a user input signal is detected by determining whether the electrical output signal exceeds an amplitude threshold.

12. The method as claimed in claim 8, wherein the user input signal is detected by determining that the electrical output signal has at least a first characteristic and a second characteristic.

13. The method as claimed in claim 12, wherein the first characteristic comprises the electrical output signal exceeding an amplitude threshold, and the method further comprising, in response to the electrical output signal exceeding the amplitude threshold, starting a first timer of a first predetermined period of time during which the electrical output signal is not monitored.

14. A non-transitory computer-readable memory storing a computer program, the computer program comprising computer program instructions, the computer program instructions executed by a processor to cause an electronic device to perform operations comprising:

processing an electrical output signal provided to the electronic device from a loudspeaker to detect, with the processing, a user input signal of the electrical output caused by at least one force applied by the user to the electronic device and transferred to the loudspeaker, wherein the electrical output signal is generated by a movement of a permanent magnet relative to a voice coil of the loudspeaker in response to the applied at least one force by the user.

15. The non-transitory computer-readable memory as claimed in claim 14, wherein the computer program instructions further enable: generating, in response to detecting the user input signal, a further electrical output signal to circuitry different to the loudspeaker wherein the further electrical output signal causes the circuitry to perform a function.

16. The non-transitory computer-readable memory as claimed in claim 14, wherein the at least one force is applied by the user indirectly to the loud speaker via another part of the electronic device associated with the loudspeaker.

17. The non-transitory computer-readable memory as claimed in claim 14, wherein a user input signal is detected by determining whether the electrical output signal exceeds an amplitude threshold.

18. The non-transitory computer-readable memory as claimed in claim 14, wherein the user input signal is detected by determining that the electrical output signal has at least a first characteristic and a second characteristic.

19. The non-transitory computer-readable memory as claimed in claim 18, wherein the first characteristic comprises the electrical output signal exceeding an amplitude threshold, and further comprising: in response to the electrical output signal exceeding the amplitude threshold, starting a first timer of a first predetermined period of time during which the electrical output signal is not monitored.

20. The non-transitory computer-readable memory as claimed in claim 19, further comprising: in response to an expiration of the first timer, starting a second timer of a second predetermined period of time during which the electrical output signal is monitored, wherein the second characteristic comprises the electrical output signal exceeding the amplitude threshold during the second predetermined period of time.

21. The apparatus as claimed in claim 7, wherein the at least one memory including the computer program code is configured, with the at least one processor, to cause the apparatus, based on the detected first and second characteristic, to perform at least one function, wherein the at least one function comprises at least one of displaying information with the apparatus and enabling a vibration function at the apparatus.

22. The method as claimed in claim 13, further comprising, in response to an expiration of the first timer, starting a second timer of a second predetermined period of time during which the electrical output signal is monitored, wherein the second characteristic comprises the electrical output signal exceeding the amplitude threshold during the second predetermined period of time.

23. The method as claimed in claim 22, further comprising, in response to the detected second characteristic performing at least one function, said function comprising at least one of displaying information with the electronic device and enabling a vibration function at the electronic device.

24. The apparatus as claimed in claim 6, wherein the applied at least one force comprises:

a first force based on a first tap on a surface of the apparatus by the user of the apparatus, wherein the first force causes the electrical output signal to exceed the amplitude threshold and start the first timer; and a second force based on a second tap on the surface of the apparatus by the user during a second predetermined period of time, wherein the second force causes the electrical output signal to exceed the amplitude threshold during the second predetermined period of time.

25. The method as claimed in claim 13, wherein the applied at least one force comprises:

a first force based on a first tap on a surface of the apparatus by the user of the apparatus, wherein the first force causes the electrical output signal to exceed the amplitude threshold and start the first timer; and a second force based on a second tap on the surface of the apparatus by the user during the second predetermined period of time, and wherein the second force causes the electrical output signal to exceed the amplitude threshold during the second predetermined period of time.

* * * * *

UNITED STATES PATENT AND TRADEMARK OFFICE

CERTIFICATE OF CORRECTION

PATENT NO. : 8,687,816 B2
APPLICATION NO. : 12/494707
DATED : April 1, 2014
INVENTOR(S) : Shengrong Shi et al.

It is certified that error appears in the above-identified patent and that said Letters Patent is hereby corrected as shown below:

IN THE CLAIMS:

Column 8, line 34, delete “loud speaker” and replace with --loudspeaker--.

Column 9, line 14, delete “loud speaker” and replace with --loudspeaker--.

Column 9, line 53, delete “loud speaker” and replace with --loudspeaker--.

Signed and Sealed this
Ninth Day of September, 2014

Michelle K. Lee

Michelle K. Lee
*Deputy Director of the United States Patent and Trademark Office*